US009352461B2

(12) United States Patent
Rodert et al.

(10) Patent No.: US 9,352,461 B2
(45) Date of Patent: May 31, 2016

(54) DEVICE AND METHOD FOR PROTECTING THE ROCK DRILLING MACHINE FROM CORROSION

(75) Inventors: Jörgen Rodert, Saltsjö-Boo (SE); Kurt Andersson, Tyresö (SE)

(73) Assignee: Atlas Copco Rock Drills AB, Örebro (SE)

( * ) Notice: Subject to any disclaimer, the term of this patent is extended or adjusted under 35 U.S.C. 154(b) by 961 days.

(21) Appl. No.: 13/382,099

(22) PCT Filed: Jun. 18, 2010

(86) PCT No.: PCT/SE2010/050699

§ 371 (c)(1),
(2), (4) Date: Feb. 29, 2012

(87) PCT Pub. No.: WO2011/002399

PCT Pub. Date: Jan. 6, 2011

(65) Prior Publication Data

US 2012/0152620 A1 Jun. 21, 2012

(30) Foreign Application Priority Data

Jul. 1, 2009 (SE) ..... 0900899

(51) Int. Cl.

| | |
|---|---|
| ***E21B 7/00*** | (2006.01) |
| ***B25F 5/02*** | (2006.01) |
| ***E21B 1/00*** | (2006.01) |
| ***B25D 17/00*** | (2006.01) |

(52) U.S. Cl.

CPC . *B25F 5/02* (2013.01); *B25D 17/00* (2013.01); *E21B 1/00* (2013.01)

(58) Field of Classification Search

CPC ..... B25F 5/02; B25D 17/00; B25D 1/04; B25D 2250/121; B25D 2250/365; E21B 1/00; E21B 17/00

USPC ..... 175/293, 57; 173/90; 166/242.4; 405/211.1

See application file for complete search history.

(56) References Cited

U.S. PATENT DOCUMENTS

| | | | | |
|---|---|---|---|---|
| 3,334,693 | A * | 8/1967 | Badcock | 173/109 |
| 4,013,487 | A * | 3/1977 | Ramqvist et al. | 148/220 |
| 4,688,828 | A * | 8/1987 | Shaffer | 285/45 |

(Continued)

FOREIGN PATENT DOCUMENTS

| | | |
|---|---|---|
| CN | 1427916 A | 7/2003 |
| CN | 2568795 Y | 8/2003 |

(Continued)

OTHER PUBLICATIONS

Office action issued by Chinese patent office in application No. 201080029112.X, Dec. 18, 2013.

(Continued)

*Primary Examiner* — Kenneth L Thompson
*Assistant Examiner* — Michael Wills, III
(74) *Attorney, Agent, or Firm* — Venable LLP; Eric J. Franklin

(57) ABSTRACT

An arrangement intended to be part of a rock drilling machine for percussive drilling. The arrangement includes a casing part with at least one plane end plane. The end plane includes at least a first region and a second region. The first region includes at least a part of the outer contour of the end plane and includes of a material that resists corrosion.

15 Claims, 5 Drawing Sheets

(56) References Cited

U.S. PATENT DOCUMENTS

| | | | | |
|---|---|---|---|---|
| 4,871,297 | A * | 10/1989 | Boes et al. | 277/406 |
| 5,785,360 | A | 7/1998 | Nordfeldt et al. | |
| 6,334,493 | B2 | 1/2002 | Lindén | |
| 2001/0026069 | A1 | 10/2001 | Linden | |
| 2007/0000694 | A1 | 1/2007 | Davies et al. | |
| 2008/0029305 | A1 * | 2/2008 | Skaff | 175/57 |
| 2008/0257107 | A1 * | 10/2008 | Liu | 75/238 |

FOREIGN PATENT DOCUMENTS

| | | | |
|---|---|---|---|
| CN | 1774317 | A | 5/2006 |
| GB | 1052778 | | 12/1966 |
| GB | 1213820 | | 11/1970 |
| GB | 2008222 | A | 5/1979 |
| GB | 2042652 | A | 9/1980 |
| JP | 54-78338 | | 6/1979 |
| JP | 61-112881 | | 7/1986 |

OTHER PUBLICATIONS

Office action issued by Japanese patent office in application No. 2012-519503, May 7, 2014.

PCT/ISA/210—International Search Report—Oct. 8, 2010.

PCT/ISA/237—Written Opinion of the International Searching Authority—Oct. 8, 2010.

* cited by examiner

DEVICE AND METHOD FOR PROTECTING THE ROCK DRILLING MACHINE FROM CORROSION

CROSS-REFERENCE TO RELATED APPLICATIONS

This application claims priority under 35 U.S.C. §119 to Swedish patent application 0900899-6 filed 1 Jul. 2009 and is the national phase under 35 U.S.C. §371 of PCT/SE2010/050699 filed 18 Jun. 2009.

TECHNICAL AREA

The present invention relates to an arrangement and a method to protect a percussive rock drilling machine in a corrosive environment.

PRIOR ART

Percussive rock drilling machines comprises for practical reasons of a number of large parts, known as casing parts, which are held together to form a drilling machine with the aid of bolted joints. Typical casing parts are the front part, gear housing, intermediate part, cylinder part and back head. Each one of the casing parts contains a large number of parts that are necessary for the function of the machine such as, for example, percussive piston, piston guides, valve guides, damping piston, etc. The casing parts are made from hardened steel for technological and economic reasons. The material is selected to satisfy several functional requirements, manufacturing requirements, and economic requirements.

The term "dividing plane" will be defined in the present context as the contact surface between two casing parts that have been assembled in a joint, and it denotes all surfaces that are in contact, independently of their orientation relative to the longitudinal axis. The dividing plane in a joint transfers power.

The term "end plane" will be defined in the present context as the totality of the surfaces of any one casing part that are included in one and the same dividing plane.

The end planes are polished to planarity and are normally oriented such that they transverse the longitudinal axis perpendicularly. The quality and surface finish of the end planes are crucial to the function of a drilling machine, and it is difficult to obtain fully plane end planes.

The slightest obliquity or irregularity may have disastrous consequences for the machine, as will be explained below.

Percussive rock drilling machines that drill underground use existing water to rinse away drill cuttings from the drill bit and drill hole. The water that is present in mines is often acidic, salty and very corrosive. The acidic, salty and corrosive rinse water from the surroundings enters irregularities in the dividing plane in the joint of a drilling machine and causes corrosion. It begins with the corrosion eating into the outermost surface, and this leads to further irregularities at which the water can attack. The degree of corrosive attack on an end plane is normally the factor that determines the lifetime of a casing part.

A known method is available to protect the dividing planes from the penetration of corrosive water and drill cuttings while it is in use. This method is to place soft sealings in grooves in the end planes. This method leads to the material outside of the grooves corroding in certain aggressive environments, and this in turn leads to the sealing grooves and the sealings being destroyed, whereby leakage arises.

Furthermore, the supply of lubricant in the form of pressurised air mixed with oil to the end surfaces that are parts of the joint is previously known in hydraulic drilling machines that are used underground. The idea is that, in addition to lubrication, in the event of a small crack arising at any position between the end surfaces, the oil and air mixture that will flow out in this situation will prevent the penetration of water and drill cuttings. If corrosion begins at the outer edge of the end surfaces, as may, despite this, occur, when the drilling machine is not being used for example, a passage is formed as time passes, through which the greater part of the oil and pressurised air mixture can pass. This leads to other parts of the end planes not being lubricated, and thus not being protected. In the absence of lubrication, there is a risk for overheating and baking to seizure since micromotion always takes place between the end planes in a drilling machine during operation.

There is, therefore, a need for an improved arrangement and method to protect the end planes and dividing planes that are parts of a joint in a percussive rock drilling machine, and in this way reduce the operational costs for rock drilling. The prior art solutions do not satisfy these needs.

SUMMARY OF THE INVENTION

It is a purpose of the present invention to provide an arrangement and a method in order to make rock drilling more cost-effective for the user, and in particular in mining environments with acidic, salty and corrosive water.

According to a first aspect, the invention relates to an arrangement intended to be part of a rock drilling machine for percussive drilling. The arrangement comprises a casing part with least one end plane, which consists of a first and a second region, where the first region comprises at least a part of the outer contour of the end plane and consists of a material that resists corrosion.

The term "material that resists corrosion" is here taken to denote a material that rusts slowly or that does not exhibit a tendency to rust.

It is primarily a part of the edge of the end plane comprising a part of the outer contour that is arranged in a material that resists corrosion. The outer edge of the end plane seals in the outward direction, and thus the conditions required for corrosive attack are eliminated in the outer contour of the joint, and the risk for corrosive attack is minimised. The invention thus has the advantage of improving the resistance to corrosive attack in the dividing plane, and it there protects primarily against crevice corrosion.

Parts of the end plane that are part of a joint and that risk being exposed to corrosive water also when the drilling machine is not in use are arranged to be of a material that resists corrosion. The material that resists corrosion should be of a very high density in order to be able to prevent water from entering. Further, the material should have a hardness that corresponds to the hardness of the base material, in order to achieve high demands on durability. The material that resists corrosion may consist of, for example, stainless steel, an alloy containing cobalt and chromium (such as that of the Stellite trademark, for example), or a suitable ceramic material.

The purpose of the invention is to prevent surface corrosive attack in the dividing plane of the joint. The oil and pressurised air mixture will, in a rock drilling machine arranged with a number of casing parts according to the invention and placed under pressure with an oil and pressurised air mixture, mainly remain within the casing of the machine and will protect the dividing planes, as intended. Effective lubrication and an effective protection against corrosive attack are in this way achieved.

The result will be a significantly increased lifetime for the casing parts, which are very expensive for the user, whereby the operating costs for each meter of drilled hole will be comparatively much lower.

Furthermore, the invention entails a reduced frequency of all types of drilling machine problems that are caused by corroding dividing planes and consequent oblique properties of the drilling machine, and this further reduces production costs during rock drilling.

The invention functions not only in rock drilling machines that comprise pressurised dividing planes, but also those that comprise dividing planes provided with sealing, such as an O-ring. It must be possible for the pressurised air to escape from pressurised dividing planes. The end planes are provided with grooves that are oriented radially and that distribute the oil and air mixture across a large part of the end planes. Leakage grooves are sometimes deliberately arranged in the end planes, starting at the inner part of the drilling machine, in order not only to increase the distribution of lubricating air across the dividing plane but also to further control the air mixture such that it is to lubricate, for example, a bolted joint.

One alternative is that the first region comprises the complete outer contour of the end plane. The first region in this case includes the complete edge region of an end plane.

One alternative is that the first region is part of a layer with a certain extent along a longitudinal axis of a casing part and thus also of the drilling machine, since the casing parts are arranged coaxially in the rock drilling machine.

Alternative attachment methods for the fixing to a casing part of the material that resists corrosion are, for example, welding, flame spraying and electrolytic coating.

One alternative is that also the second region consists of a material that resists corrosion. Thus the complete end plane is constituted by a material that resists corrosion.

One embodiment of the invention is constituted by a joint in a percussive rock drilling machine comprising at least two casing parts. The casing parts are designed according to any one of the alternatives described above, and they are arranged such that the regions of material that resists corrosion are in sealing contact. It is a part of the innovative concept of the invention that the regions consisting of material that resists corrosion have the same form, such that they cover each other in the dividing plane.

One embodiment of the invention is constituted by a percussive rock drilling machine comprising at least one joint arranged as described above. The joint is radially located such that the first regions of material that resist corrosion are arranged at the rock drilling machine where the risk of corrosion is greatest. The location of these regions takes place taking into consideration, among other factors, the type of rock drilling machine, the type of joint, the type of bolt and their locations within a bolted joint. Consideration is also taken of the risk of corrosion in situations when the rock drilling machine is not in operation.

Thus no corrosion arises within the protective edge regions of material that resists corrosion. The casing parts achieve a lifetime that is comparatively significantly increased, probably several times longer, in locations with very acidic, salty or corrosive water.

It is part of the innovative concept of the invention that the arrangement is part of rock drilling machines for drilling underground in mines with at least one of acidic and salty water.

Pressurisation of the rock drilling machine takes place while it is in operation such that oil and air mixture is supplied to the interior of the drilling machine under pressure, as has been described above. The purpose is to lubricate and to protect from corrosion the contact surfaces and dividing planes between the casing parts, and the parts of the casing parts, during operation.

If the end planes have surface defects or if they are not completely plane, there is a risk that the pressurised oil and air mixture may pass in an uncontrolled manner out of the drilling machine instead of circulating in the interior of the machine and lubricating the component parts, as described above. There is, furthermore, a risk that at least one of acidic, salty and corrosive water penetrate between the end planes and cause corrosion. The corrosion of the end planes leads in turn to further passageways out through which the oil and air mixture can flow in an uncontrolled manner.

According to a second aspect, the invention relates to a method intended to protect from corrosion a rock drilling machine for percussive drilling comprising a number of joints with a number of casing parts, each one of which comprises at least one end plane that consists of at least a first and a second region. The first region comprises at least a part of the outer contour of the end plane and consists of a material that resists corrosion. The method comprises the assembly of a rock drilling machine by joining a number of casing parts with first regions that are similarly formed in pairs, such that the first regions in a number of joints cover each other in a manner that produces a seal.

The method comprises further the pressurising of the joints in the rock drilling machine during operation by an oil and air mixture whereby the first regions in each joint seal and prevent the oil and air mixture from passing out, and at the same time seal and prevent corrosive water in the surroundings from penetrating the component dividing planes, whereby the oil and air mixture lubricates the second regions that are part of each dividing plane.

The method according to the invention has the advantage that the oil and air mixture lubricates the contact surfaces between the inner components of the drilling machine at the same time as the sealing end planes prevent the oil and air mixture from passing out in an uncontrolled manner through the dividing planes.

If the outer part of the dividing planes never corrodes, the oil and pressurised air mixture will largely remain within the casing of a drilling machine and it will protect the planes as intended.

The oil and air mixture is caused to pass out through the second regions in an alternative method according to the invention. This can take place in a guided and controlled manner through, for example, passage through the above-mentioned leakage grooves.

BRIEF DESCRIPTION OF THE DRAWING

The invention will be explained in more detail below by describing different embodiments of it, based on the attached drawing, in which.

DESCRIPTION OF ALTERNATIVE EMBODIMENTS

A percussive rock drilling machine 1 (FIG. 1) comprises of a number of large parts known as casing parts 1*a-g*, which are held together by joints 11, such as bolted joints. Typical casing parts are the front part, gear housing, intermediate part, cylinder part and back head. Each one of the casing parts contains a large number of parts that are necessary for the function of the machine such as, for example, hammer piston, piston guides, valve guides, and damping piston. The functions of these parts are not affected by the present invention.

Figure 1:
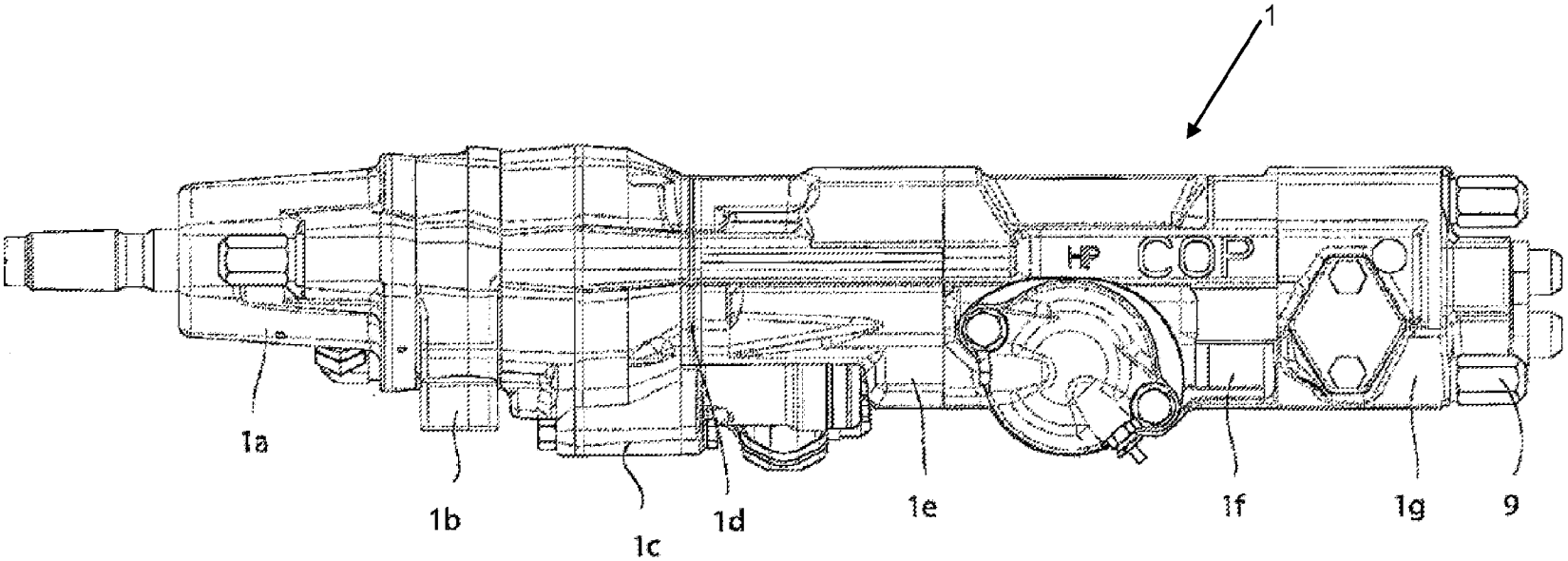
FIG. 1 shows a percussive rock drilling machine comprising at least one arrangement according to the invention.
Figure 2:
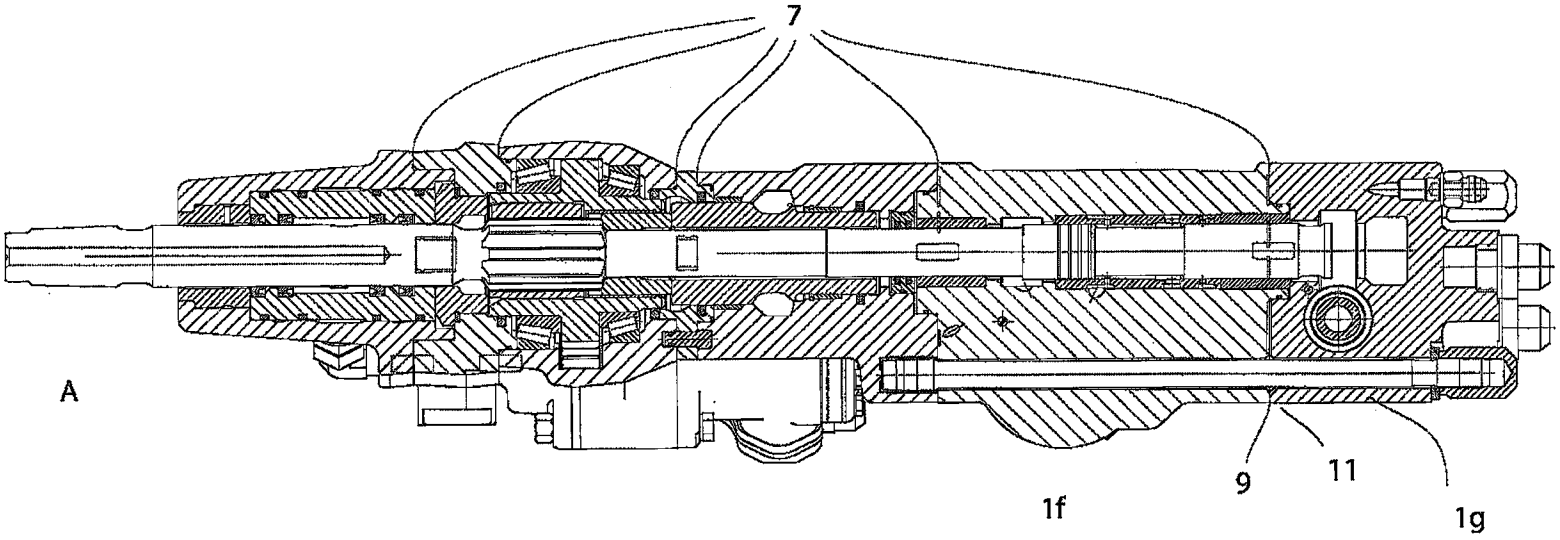
FIG. 2 is a cross-section of the rock drilling machine shown in FIG. 2.

FIG. 2 is a cross-section through a rock drilling machine according to FIG. 1 and shows that the components of each pair of casing parts make contact at a dividing plane 7 on assembly. FIG. 2 shows that a first 1*f* and a second 1*g* casing part are united at a joint 11 with a number of bolts 9.

Two neighbouring end planes 3 (FIG. 3) form a dividing plane 7 in the drilling machine. Each dividing plane 7 is thus formed by two opposing end planes 3 when the casing parts involved are united by a joint 11. The end plane 3 of a casing part can be said to constitute an assembly surface for the next casing part in a drilling machine.

Figure 3:
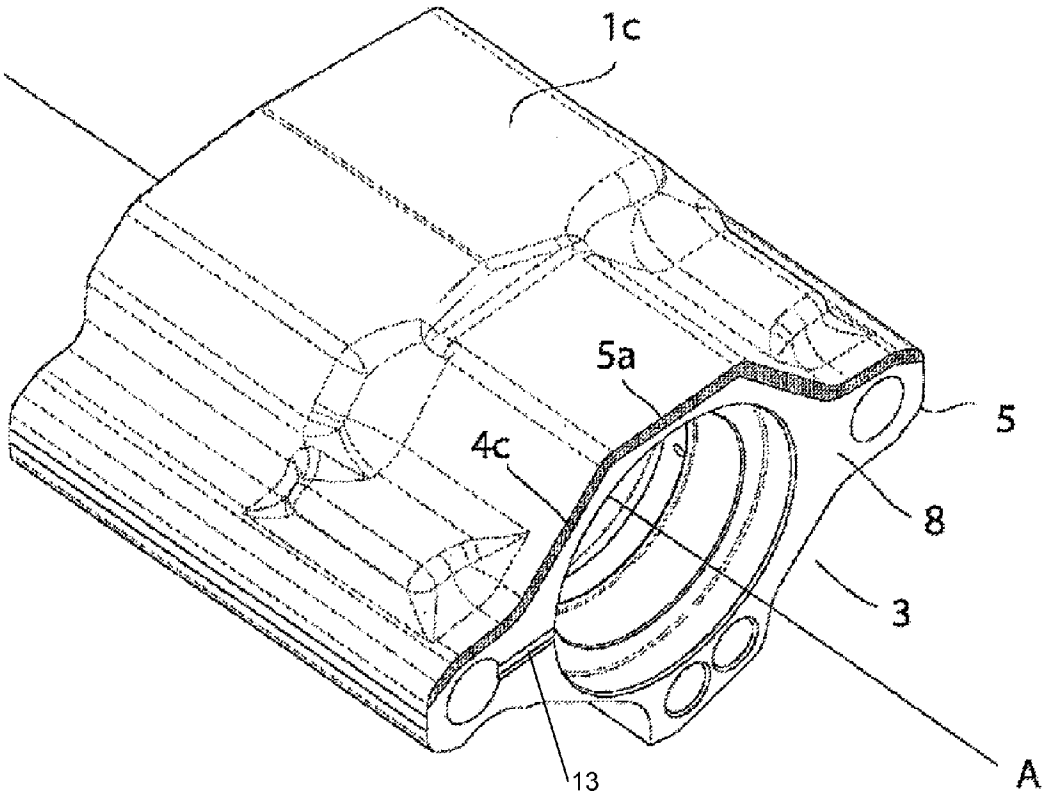
FIG. 3 shows an arrangement according to the invention.

FIG. 3 shows a casing part 1*c* comprising an end plane 3 with a first region 4 that consists of a material that resists corrosion. The first region 4 comprises a part 5*a* of the outer contour 5 of the end plane and thus includes a part of the outer edge of the end plane 3. When the casing part 1*c* has been assembled and is a component of a rock drilling machine 1, the first region 4 will be located in a region of the drilling machine at which the risk of corrosion is high, according to the description above. The end plane 3 comprises also a second region 8 that consists of the base material of the casing part 1*c*; hardened steel, for example.

Figure 4:
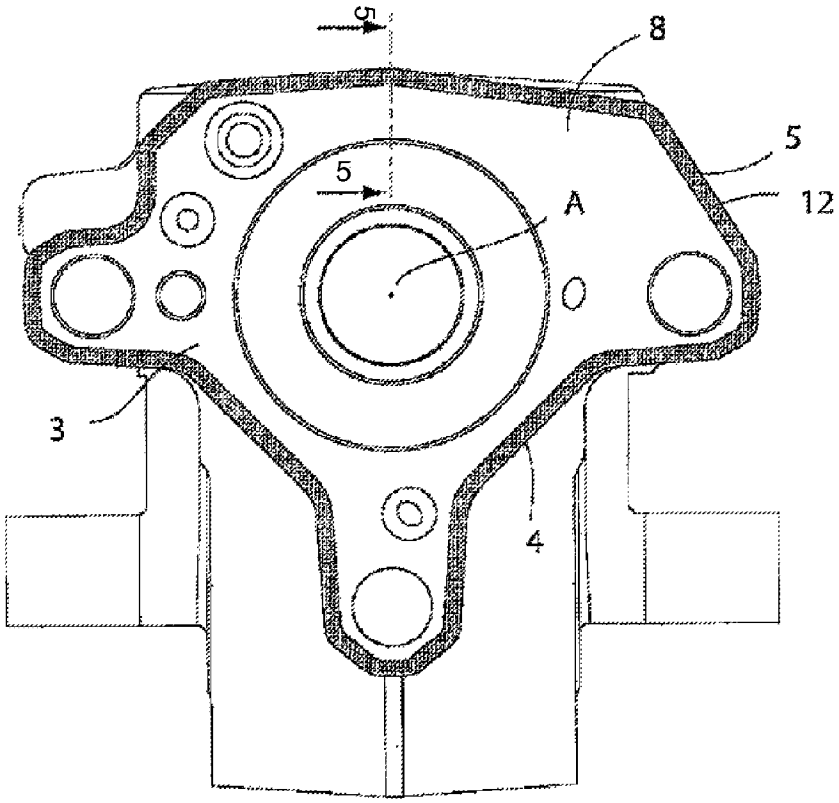
FIG. 4 shows an alternative arrangement according to the present invention.

The first region 4 comprises in an alternative embodiment the complete outer contour 5 of the end plane 3 and it thus includes the complete edge region 12 of the end plane 3 (FIG. 4).

A groove is milled around at least a part of the outer contour 5 of the end plane 3 during the machining of a casing part such as the casing part 1*c* in FIG. 3. It is suggested that the groove be milled to a depth of a couple of millimeters, and a width of approximately 10 mm. The groove is then filled by welding, with a material that resists corrosion. The casing part is subsequently case-hardened and machined to completion. The final result will be a casing part with an end plane that comprises an edge region that, at least to a certain extent, consists of a material that resists corrosion.

Figure 5:
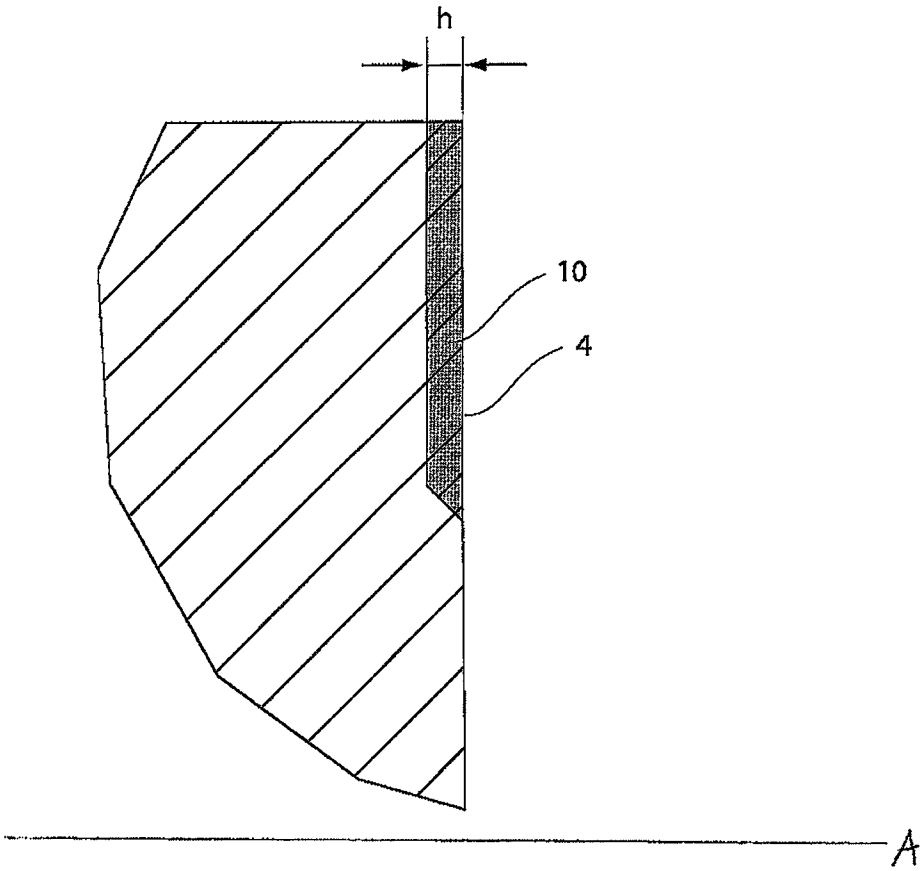
FIG. 5 is a cross-section through one part of the arrangement according to the present invention.

FIG. 5 is a cross-section through the outer edge 12 of the end plane 3 shown in FIG. 4. FIG. 5 shows a layer 10 with a certain extent h along the longitudinal axis A, manufactured according to the description above. The first region 4 is part of the layer 10 and constitutes an outer limiting surface of the layer 10.

A rock drilling machine that comprises casing parts according to the invention has a number of dividing planes 7, each one formed from two end planes 3. The rock drilling machine thus has an outer casing that is held together by a number of joints 11, normally bolted joints, that are comparatively highly sealing. When the rock drilling machine starts operation, it is placed under pressure with the oil and air mixture whereby the joints 11 according to the invention prevent water from the surroundings penetrating in through the dividing plane 7 and furthermore prevent the oil and air mixture from passing out through the dividing plane 7 in an uncontrolled manner. The invention has the advantage that the joints 11 can withstand contact with salty, acidic and corrosive water significantly better, without being attacked by corrosion.

It should be pointed out that the end planes in a drilling machine according to the invention can be provided with deliberate grooves 13 such that it will be possible for the oil and air mixture to flow out into the dividing planes 7 in a controlled manner and lubricate these planes. The oil and air mixture can be caused also to continue to flow and to lubricate, for example, the bolts that are components of the joint.

The invention claimed is:

1. An arrangement for a rock drilling machine for percussive drilling, the arrangement comprising:

a casing part comprising a base material and at least one end plane, wherein the end plane comprises a first region and a second region, wherein the first region comprises at least one part of an outer contour of the end plane at least partially surrounding the second region and having a surface that is coplanar with the end plane, and wherein the first region comprises a material that resists corrosion, the material comprising stainless steel, an alloy or ceramic.

2. The arrangement according to claim 1, wherein the first region comprises a complete outer contour of the end plane.

3. The arrangement according to claim 1, wherein the second region comprises a material that resists corrosion.

4. The arrangement according to claim 1, wherein the second region comprises the base material.

5. The arrangement according to claim 1, further comprising:

at least one groove in the end plane, the at least one groove configured to permit lubricating oil and air mixture to pass from an interior of the casing part to an exterior of the casing part.

6. The arrangement according to claim 1, wherein the material that resists corrosion overlies the base material.

7. A joint in a hammer rock drilling machine, comprising:

two casing parts each comprising a base material and at least one end plane, wherein the end plane comprises a first region and a second region, wherein the first region comprises at least one part of an outer contour of the end plane at least partially surrounding the second region and having a surface that is coplanar with the end plane, and wherein the first region comprises a material that resists corrosion, the material comprising stainless steel, an alloy or ceramic, wherein the first regions of the casing parts that comprise material that resists corrosion have a same shape and are arranged in sealing contact in a dividing plane.

8. The joint according to claim 7, wherein at least one of the casing parts further comprises at least one groove in the end plane, the at least one groove configured to permit lubricating oil and air mixture to pass from an interior of the casing part to an exterior of the casing part.

9. The joint according to claim 7, wherein the material that resists corrosion overlies the base material.

10. A rock drilling machine arranged for percussive drilling, comprising:

at least one joint comprising two casing parts each comprising a base material and at least one end plane, wherein the end plane comprises a first region and a second region, wherein the first region comprises at least one part of an outer contour of the end plane at least partially surrounding the second region and having a surface that is coplanar with the end plane, and wherein the first region comprises a material that resists corrosion, the material comprising stainless steel, an alloy or ceramic, wherein the first regions of the casing parts that comprise material that resists corrosion have a same shape and are arranged in sealing contact in a dividing plane, and wherein the joint is radially positioned such that the relevant first regions of material that resists corrosion cover each other and are arranged in a region of the drilling machine at which the risk of corrosion is greatest.

11. The rock drilling machine according to claim 10, wherein at least one of the casing parts further comprises at least one groove in the end plane, the at least one groove configured to permit lubricating oil and air mixture to pass from an interior of the casing part to an exterior of the casing part.

12. The rock drilling machine according to claim 10, wherein the material that resists corrosion overlies the base material.

13. A method to protect from corrosion a rock drilling machine for percussive drilling, comprising a number of joints with a plurality of casing parts each one of which comprising a base material and at least one end plane, where the end plane comprises a first and a second region, where the first region comprises at least one part of the outer contour of the end plane at least partially surrounding the second region and having a surface that is coplanar with the end plane, and wherein the first region comprises a material that resists corrosion, the material comprising stainless steel, an alloy or ceramic, the method comprising:

assembling a rock drilling machine by joining a plurality of casing parts with first regions that are similarly formed in pairs, such that the first regions in a number of joints cover each other in a manner that produces a seal, and pressurizing the joints in the rock drilling machine during operation by an oil and air mixture whereby the first regions in each joint seal and prevent the oil and air mixture from passing out through the first regions, and at the same time seal and prevent corrosive water in surroundings of the rock drilling machine from penetrating the component dividing planes, whereby the oil and air mixture lubricates second regions that are part of each dividing plane.

14. The method according to claim 13, wherein the material that resists corrosion overlies the base material.

15. The method according to claim 13, wherein the oil and air mixture is caused to pass out through at one groove in at least one of the end planes to lubricate the joints.

* * * * *